US005277256A

United States Patent [19]

Bailey

[11] Patent Number: 5,277,256

[45] Date of Patent: Jan. 11, 1994

[54] FIREFIGHTER'S NOZZLE

[76] Inventor: Dallas J. Bailey, 8100 SW. 37th Ter., Miami, Fla. 33155

[21] Appl. No.: 941,878

[22] Filed: Sep. 8, 1992

Related U.S. Application Data

[63] Continuation-in-part of Ser. No. 767,070, Sep. 27, 1991, abandoned.

[51] Int. Cl.[5] ..... A62C 31/07

[52] U.S. Cl. ..... 169/15; 169/52; 239/416.1; 239/418; 239/427.5

[58] Field of Search ..... 169/14, 15, 44, 52; 239/413, 416.1, 418, 427.5

[56] References Cited

U.S. PATENT DOCUMENTS

| | | | |
|---|---|---|---|
| 1,362,228 | 12/1920 | Cleveland | 239/416.1 X |
| 2,245,195 | 6/1941 | Hopkins | 239/413 X |
| 2,271,800 | 2/1942 | Meussdorffer | 239/444 X |
| 2,307,014 | 1/1943 | Becker et al. | 239/444 X |
| 2,485,723 | 10/1949 | Fitzgerald | 169/14 |
| 3,448,809 | 6/1969 | Lambert et al. | 169/15 |
| 4,640,461 | 2/1987 | Williams | 169/15 X |
| 4,729,434 | 3/1988 | Rohrbach | 169/15 X |

*Primary Examiner*—David M. Mitchell
*Assistant Examiner*—Gary C. Hoge
*Attorney, Agent, or Firm*—Malloy & Malloy

[57] ABSTRACT

A fire suppression nozzle device, to be used by firefighters to selectively and immediately utilize a plurality of different firefighting agents through the single nozzle when circumstances require, the nozzle including a housing having a primary conduit wherethrough water at substantially high pressure and high volume may be emitted, a secondary conduit with a venturi outlet extending into the primary conduit such that a second firefighting agent flowing through the secondary conduit will be drawn into the primary conduit as a result of a venturi effect suction for mixture with the water passing through the primary conduit and emission out an adjustable flow tip on a downstream, open end of the primary conduit, and a third conduit having a fixed emission tip and adapted to receive a high pressure flow of a third firefighting agent therethrough and out a fixed emission tip, all of the conduits including flow control valves to enable facilitated flow adjustment and utilization of a particular firefighting agent only when desired.

9 Claims, 2 Drawing Sheets

FIG. 4
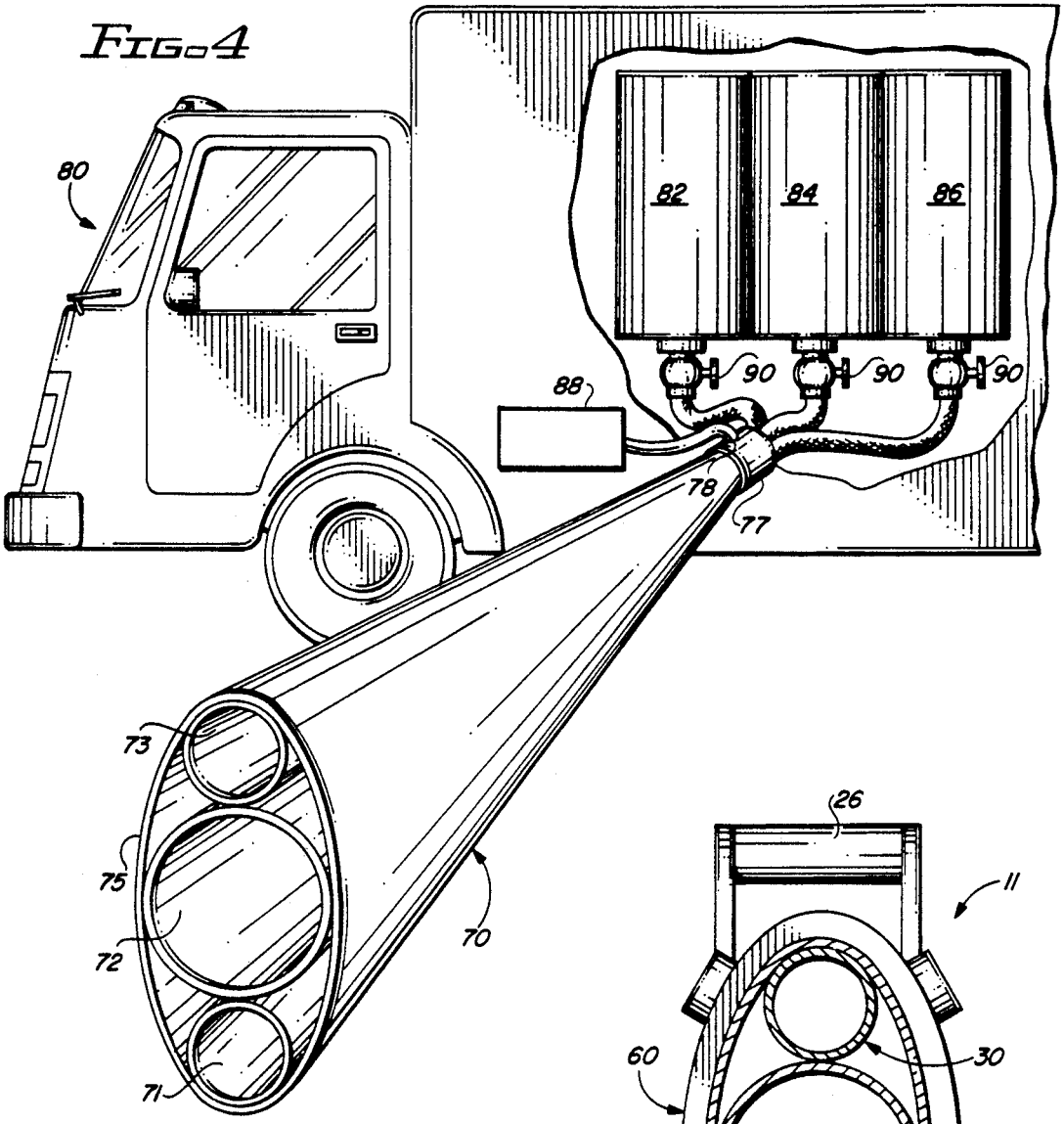
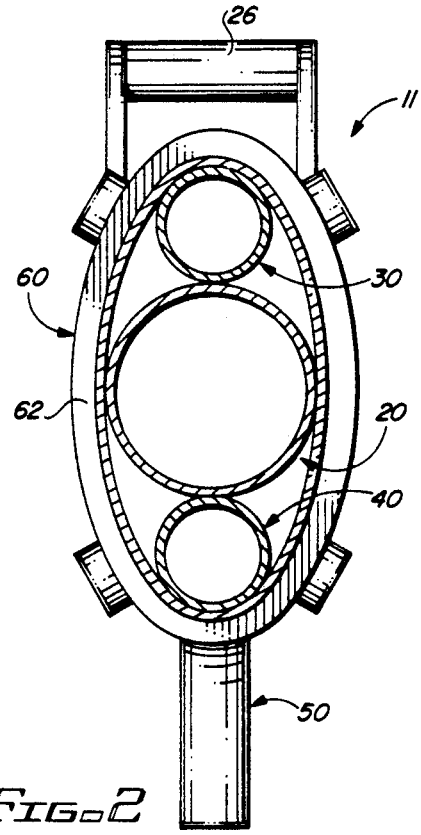
FIG. 2

FIREFIGHTER'S NOZZLE

BACKGROUND OF THE INVENTION

The present is a continuation-in-part application to the prior patent application filed Sep. 27, 1991, and assigned Ser. No. 767,070, abandoned.

FIELD OF THE INVENTION

The present invention relates to a fire suppression nozzle device which can receive three independent firefighting agents therethrough for selective use by a firefighter, thereby providing a firefighter with the ability to utilize the firefighting agent which is most effective for a particular circumstance immediately and through the single nozzle.

DESCRIPTION OF THE RELATED ART

Firefighters are highly trained and educated in their field, and are generally capable of distinguishing between types of fires and assessing the emergency circumstance independently, on a moment's notice. With the many technological advances involved in firefighting, firefighters now have available a variety of firefighting agents besides water. The preferred firefighting agents, other than water, include fire suppression foam (aqueous forming foam as it is known in the trade AFFF, or the new type of foam material known as Class "A"), and compressed Halon gas or other fire suppressant gas. Halon is an agent which chemically interferes with the combustion process of a fire, thus breaking up its complex chemical reaction, and although it is highly effective, is not readily used as a result of its high cost. Also, fire suppression foam is considerably more expensive than water and usually requires a substantial quantity to "drown" a fire.

Due to the increased expense of utilizing foam or Halon, these firefighting agents are generally available in only specific circumstances and usually require special rigs and prior planning to use. Even though firefighters would be capable of making the necessary decisions regarding when to use one of the special firefighting agents, such as in an eminent backdraft or flash-over condition which could be neutralized utilizing a quick burst of Halon, firefighters do not have that option because the special agents have not been prepared or are not immediately available in most circumstances. Further, due to water shortages in many cities, and a desire to cause minimal water damage when putting out a fire, the benefits of utilizing small amounts of a special firefighting agent immediately to stop a fire before it spreads, substantially decrease the time required to put out a fire, or to conserve substantial quantities of water, are being seen to outweigh the added cost. Additionally, because a large percentage of fire department calls involve rescue situations and not full-blown fires, the need for large, specifically adapted fire trucks with substantial water reservoirs would be minimized by enabling the use of smaller, more efficient, combination rescue and firefighting vehicles, which could have quicker response times, do not require such a large payload of firefighting agents as a result of the availability of smaller quantities of a variety of more effective firefighting agents which could be used to suit a particular situation, and require smaller crews to provide equivalent firefighting potential.

For the previously stated reasons, it would be highly beneficial to have a firefighting nozzle which could be interconnected with multiple firefighting agent sources, such as water, fire suppression foam, and Halon, so as to make each of the firefighting agents immediately and readily available, while allowing the firefighter's judgment to dictate the immediate and actual necessities of a particular emergency circumstance. Presently known in the art, are numerous types of firefighting nozzles adapted to improve the use of water for firefighting circumstances. If firefighting agents in addition to water are needed, independent agent dispensing means must be specially brought to the needed location, for separate independent use, and often a great deal of planning and preparation is needed to use these special firefighting agents. Accordingly, despite the numerous advances in the firefighting art, a firefighting nozzle which can enable multiple firefighting agents to be immediately available is still required. The present invention is designed precisely to meet those needs by receiving three independent firefighting agent sources for fluid flow connection therewith, and while making the favorite firefighting agent, namely water, the central focus, also provides the availability of a Halon burst and a suppression foam spray by merely opening a corresponding valve.

Additionally in the prior art, fertilizer dispenser nozzles, such as that disclosed in the patent to Chan, U.S. Pat. No. 4,039,105, have been structured to spray multiple fluids. The dispenser of Chan, however, is not adapted to receive high pressure water flows, and includes connection means to secure it to only a single fluid source at its upstream end, namely a water hose. The fertilizer, which is to be dispensed with the water, is contained within a reservoir at the nozzle itself, and is not adapted to spray with any force unless mixed with the water. Further, as is evidenced by the presence of a water inlet 24 which leads to the fertilizer reservoir, the fertilizer, which is the only fluid other than water which may be dispensed by the nozzle at any given time, must be mixed with water if it is to flow from the reservoir. Also, the limited supply of fertilizer available in the reservoir must be prepared prior to use of the hose, as it may not be independently introduced through the upstream and of the nozzle when it is actually required. As a result, such a fertilizer dispenser could not meet the needs of a firefighting nozzle which must spray multiple firefighting agents independently receives three independent supplies of the firefighting agents when needed for immediate use, and can emit a substantially high pressure flow required for firefighting.

SUMMARY OF THE INVENTION

The present invention is directed towards a fire suppression nozzle device adapted to enable firefighters to selectively, and immediately utilize one, or a combination of a variety of firefighting agents to meet the actual needs of an emergency firefighting situation. The nozzle device includes a primarily a housing having an upstream end and a downstream end. Centrally disposed along the housing is a primary water conduit which extends therethrough. This water conduit is structured and disposed to transmit water at a substantially high pressure and high volume of at least 50 gallons per minute therethrough, so as to be effective for firefighting situations. Disposed on a downstream, open end of the primary conduit is an adjustable flow tip. The flow tip is adapted to control the type of spray emission of water which exits the primary conduit, thereby enabling a concentrated flow or a softer spray flow to be emitted. Disposed within the primary conduit is a first, exteriorly operable flow control valve. This first valve is adapted to enable a user to regulate the flow of water through the primary conduit between a maximum flow position and a no-flow position. Further disposed within the housing is a secondary conduit which extends parallel with the primary conduit from the upstream end of the housing. Included at a downstream end of the secondary conduit is a venturi outlet. This venturi outlet is curved to extend into the primary conduit such that fluid flowing through the secondary conduit will pass into the primary conduit as a result of a venturi effect suction. Accordingly, when water passes through the primary conduit, fluid within the secondary conduit will be sucked into the primary conduit for subsequent passage out of the housing through the adjustable flow tip on the primary conduit. Disposed within the secondary conduit is a second exteriorly operable flow control valve. This second valve is adapted to control the flow of fluid through the secondary conduit between no flow and maximum flow. Additionally included within the housing is a third conduit. This third conduit, which extends substantially parallel with the primary conduit, from the upstream end of the housing, is adapted to direct a high pressure flow therethrough, and includes a fixed emission tip which is independently operable, allowing a high pressure flow to exit through the fixed emission tip whether the primary conduit is active with a water flow or not. Disposed within the third conduit is a third exteriorly operable flow control valve. This third valve is adapted to allow concentrated fluid bursts, constant flow, or zero flow through the fixed emission tip of the third conduit. At the upstream end of the housing are hook up means. These hook up means are adapted to securely receive at least three firefighting agent sources. Once received within the hook up means, the three firefighting agent sources are connected in secure, corresponding, fluid flow communication with open upstream ends of the primary conduit, the secondary conduit, and the third conduit.

It is an object of this invention to provide a firefighter's nozzle which is capable of delivering selectively, three different types of firefighting agents to quickly and efficiently extinguish a wide variety of types of fires.

It is a further object of the present invention to provide a firefighter's nozzle which can receive three independent extinguishing agents under high pressure for selective, immediate disbursement.

Still another object of the present invention is to provide a firefighter's nozzle which enable a firefighter to make immediate decisions as to the use of a preferred firefighting agent necessary for a particular situation.

Yet another object of the present invention is to provide a firefighter's nozzle which can be incorporated as part of a quick response firefighting unit which has the capability of selectively utilizing multiple fire disbursement mediums.

BRIEF DESCRIPTION OF THE DRAWINGS

For a fuller understanding of the nature of the present invention, reference should be had to the following detailed description taken in combination with the accompanying drawings in which:

FIG. 2 is an upstream view of the firefighting nozzle of the present invention along line 2'—2' of FIG. 1.

FIG. 4 is a perspective view of the triple flow hose and firefighting agent source to be used with the firefighting nozzle of the present invention.

Like reference numerals refer to like parts throughout the several views of the drawings.

DETAILED DESCRIPTION OF THE PREFERRED EMBODIMENT

Figure 1:
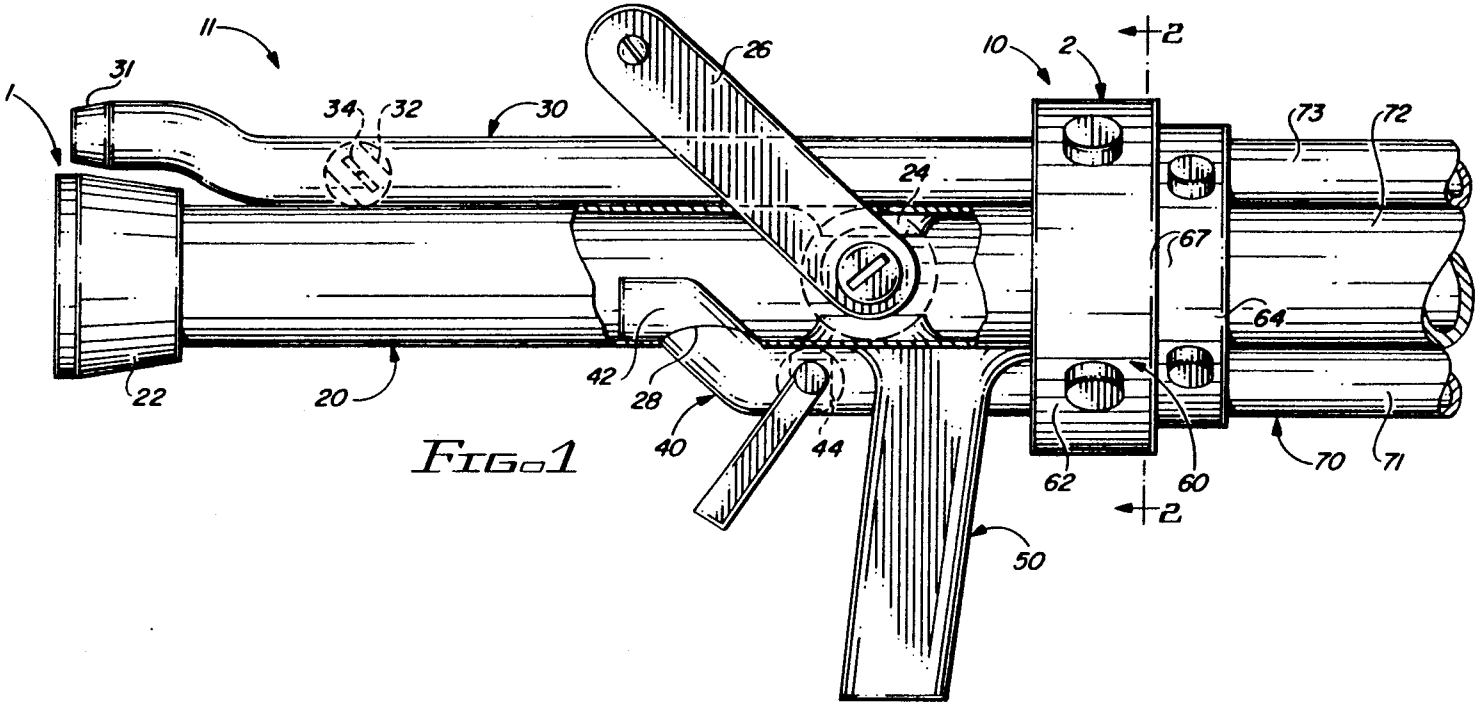
FIG. 1 is a side view of the firefighting nozzle of the present invention.

As shown in the drawings, the present invention is directed towards a fire suppression nozzle device, generally indicated as 11. The nozzle device 11 primarily includes a sturdy housing 10 having a downstream end 1 and an upstream end 2. Included within the housing are three separate conduits 20, 30, and 40. The primary conduit 20 is centrally disposed within the housing 10 and is adapted to receive high volume and high pressure water flow therethrough. When used in firefighting, the water flows at a rate of at least 50 to 100 gallons per minute or more, and accordingly, the primary conduit 20 is large and sturdy enough to emit such a flow. Located at a downstream end of the primary conduit 20 is an adjustable flow tip 22. This adjustable flow tip 22 enables a firefighter utilizing the nozzle 11 to regulate the type of spray emission coming from the downstream end of the primary conduit 20 in accordance with the particular needs of a particular firefighting situation. Included within the primary conduit 20, near the upstream end 2 of the housing 10, is a first flow control valve 24. This first flow control valve 24 is preferably a ball-type valve having a diametric flow through passageway such that the flow of water through the primary conduit 20 may be varied anywhere between a completely open maximum flow or a closed zero flow, depending on the needs of the particular situation. So as to enable the firefighter to selectively adjust the water flow, and/or completely shut it off, the first control valve 24 is exteriorly operable by means of a handle 26. The handle 26 is sufficiently elongate so as to enable a firefighter to easily regulate water flow using only a single hand, while also using that same hand to maintain a secure hold on the nozzle 11.

Further, the housing 10 includes a secondary conduit 40. This secondary conduit 40 which extends from the upstream end 2 of the housing 10 in substantially parallel relation with the primary conduit 20 and includes an angled venturi outlet portion 42 which extends through an opening 28 in the primary conduit 20 such that the flow passing through the secondary conduit 40 is directed into the primary conduit 20. Included within the secondary conduit 40 is a second flow control valve 44, preferably a ball-type valve having a diametric flow through passageway, which is exteriorly operable by means of a handle 45 between a no-flow and a maximum flow position. This secondary conduit 40 is primarily adapted to receive the flow of AFFF or Class "A" foam. As a result of the positioning of the venturi outlet 42 within the primary conduit 20, the high pressure flow of water through the primary conduit in essence draws the foam from the secondary conduit 40 with it, when the secondary conduit 40 is open to allow the flow of foam therethrough. Accordingly, the proper mixture of foam and water may be achieved on a moment's notice so as to enable a firefighter in the midst of a fire to be able to selectively utilize the foam when it is necessitated for a particular hazard.

Additionally, the housing 10 includes a third conduit 30, also capable of directing a high pressure flow therethrough. This third conduit 30, in the preferred embodiment, is adapted to direct Halon gas out a fixed emission tip 31 at the downstream end 1 of the housing 10. Positioned within the third conduit 30 is a third flow control valve 32, which in the preferred embodiment is a butterfly valve. This third flow control valve 32, which is exteriorly operable by means of a handle 34, is adapted to regulate the flow of gas through the third conduit 30 from zero flow to maximum flow. As a result of the high cost of Halon or other gas extinguishing agents such as $CO_2$ as well as the effectiveness of small quantities of the gas, the third valve 32 may be structured to enable quick bursts of the gas to be emitted, thereby making this highly effective firefighting medium useable upon a moment's notice when a crucial situation arises.

Extending substantially perpendicularly from the housing 10 is a nozzle gripper handle 50. This nozzle gripper handle 50 is disposed to enable a firefighter to maintain a secure hold of the nozzle 11 with one hand, while their other hand may be used to adjust any of the handles 26, 34, or 45, as needed in a particular situation. Also, as a result of the high pressure flow which is being emitted from the nozzle 11, a secure hold of the nozzle 11 which will maintain the firefighter's grip free from accidental activation of an additional firefighting agent, is highly beneficial.

Figure 3:
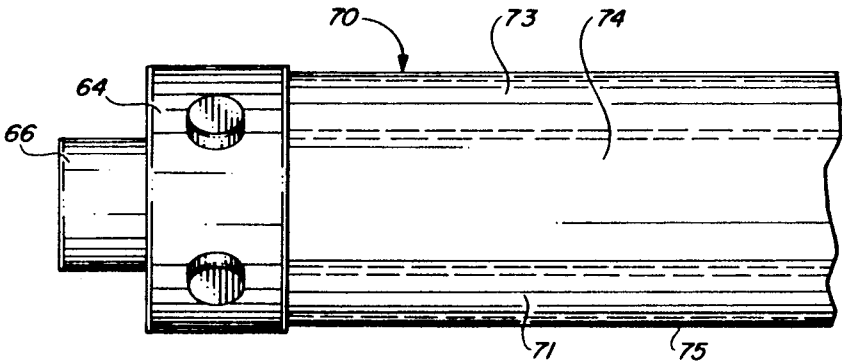
FIG. 3 is a side view of an unattached triple flow hose to be connected to the firefighting nozzle of the present invention.

Disposed at the upstream end 2 of the housing 10 are hook up means 60. These hook up means 60 will preferably include a standard-type couple 62, which in the preferred embodiment includes a generally oval shape. As shown in FIG. 2, the primary conduit 20, secondary conduit 40, and third conduit 30, are open and adapted to receive fluid therein from this upstream end 2 of the housing 10. The couple 62, which may receive three independent and separate firefighting agent sources therein for connection with the conduits 20, 30, and 40, is preferably adapted to hook up with a lock head of a specially adapted triple flow hose 70. As detailed in FIGS. 3 and 4, the triple flow hose 70 includes three independent agent conduits 71, 72, and 73 secured within an outer sleeve 75 so as to form a single triple flow hose 70. The lock head of the triple flow hose 70, which is also generally oval in shape, includes a mating couple 64 at its distal end which is adapted for insertion, and locking engagement within the couple 62 of the housing 10. In order to assure a secure and tight fit, the hose couple 64 includes a protruding central portion 66, wherethrough the central agent conduit 72 may be in fluid flow communication with the primary conduit 20, adapted to be inserted into the couple 62 on the housing 10 such that 90° lock turn may secure the connection and the outer agent conduits 73 and 71 may be correspondingly positioned in fluid flow communication with the secondary conduit 40 and third conduit 30. Gaskets included on the couples 62 and 64 would assure a tight seal, and indicia 67 on an exterior surface of the couples 62 and 64 (see FIG. 1) are positioned to clearly indicate when the couples 62 and 64 have been turned to the fully locked, fluid flow connected position. Similarly, a proximal end 77 of the hose 70 is adapted to be connected with a multiple firefighting unit 80, as best seen in FIG. 4. In the preferred embodiment, the multiple firefighting unit 80 is in the form of a fire rescue-type truck, which is substantially smaller than standard firefighting tanker-type vehicles so as to enable it to provide quick responses, and function as both a firefighting unit and as a rescue unit. Contained within the multiple firefighting unit 80 are at least three independent agent tanks 82, 84, and 86. Each of these tanks 82, 84, and 86 is adapted to retain a quantity of a single firefighting agent, such as foam, water, and Halon gas. Each of the tanks 82, 84, and 86 is connected in fluid flow communication with the proximal end 77 of the triple hose 70, such that the corresponding firefighting agent will pass into the corresponding agent conduit 71, 72, and 73, of the hose 70. Also included at the proximal end 77 of the hose 70 is an air inlet 78. The air inlet 78 is connected with a compressed air source 88 and is adapted to allow the flow of air to enter the conduits 71 and 73 of the hose 70 so as to substantially fill them with air. Preferably, only the outer conduits 71 and 73 will be filled, since the central conduit 72 wherethrough water is passed will almost always be active. Through the air inlet 78, the agent conduits 71 and 73 are filled with air after connection. Since the flow control valves 32 and 44 of the third conduit 30 and secondary conduit 40 will initially be closed, air will pass into the agent conduits 71 and 73 only until they are full. Once filled with air, the outer agent conduits 71 and 73 will remain filled until a firefighter calls for a particular agent through that conduit, resulting in the immediate emission of the air through the nozzle 11, and causing a sudden pressure drop within the agent conduit 71. This sudden pressure drop is detected by a corresponding pressure sensitive solenoid 90 which regulates the flow from each of the agent tanks 82, 84, and 86. Upon detection of the sudden pressure drop, the solenoid valve 90 in the corresponding conduit opens allowing the immediate and rapid flow of the desired agent to the nozzle 11. By not having the hose 70 immediately filled with the more expensive firefighting agents such as foam or Halon gas, the quantity which would be held by the hose 70 will not be wasted when disconnecting the hose, but as a result of the air pressure and sudden drop thereof when an agent is needed, the agent will be rapidly sucked to the nozzle 11 for immediate use.

Now that the invention has been described,

What is claimed is:

1. A fire suppression nozzle, comprising:

a) A housing having an upstream end and a downstream end, b) said housing including a primary water conduit extending therethrough, c) said primary water conduit being structured and disposed to transmit water at a substantially high pressure and high volume of at least 30 gallons per minute therethrough, d) an adjustable float tip on a downstream, open end of said primary conduit, said flow tip controlling the type of spray emission of water from said primary conduit, e) a first, exteriorly operable float control valve in said primary conduit, said first valve being structured and disposed to regulate the flow to said primary conduit, f) said housing further including a secondary conduit, said secondary conduit extending along said housing from said upstream end of said housing toward said downstream end thereof, g) said secondary conduit including a venturi outlet adjacent a downstream thereof, said venturi outward disposed in fluid communication with an interior of said primary conduit such that said fluid flowing through said secondary conduit will pass into said primary conduit, as a result of a venturi effect suction caused when the water passes through said primary conduit, for subsequent passage out of said housing through said adjustable flow tip on said primary conduit, h) a second exteriorly operable valve in said secondary conduit, said second valve regulating the flow of fluid through said secondary conduit, i) said housing including a third conduit, capable of directing a high pressure flow therethrough, extending along said housing with said primary conduit from said upstream end towards said downstream end and further including an emission tip thereon, j) a third exteriorly operable flow control valve in said third conduit, said third valve being structured and disposed to regulate fluid flow through said third conduit, k) a triple flow hose including a lock head and at least three independent agent conduits, said lock head being structured and disposed for secure fluid flow connection at said upstream end of said housing such that each of said agent conduits is correspondingly connected with a different one of said primary conduit, said secondary conduit, and said third conduit, and l) hook up means at said upstream end of said housing, said hook up means being structurally adapted to securely receive said triple flow holes therein.

2. A nozzle device as in claim 1 wherein said first flow control valve includes a ball type valve having a diametric flow through passageway.

3. A nozzle device as in claim 2 wherein said second flow control valve includes a ball type valve having a diametric flow through passageway.

4. A nozzle device as in claim 3 wherein said third flow control valve includes a butterfly type valve.

5. A nozzle device as in claim 4 further including handle means connected to said first flow control valve, said second flow control valve, and said third flow control valve such that each of said handle means may correspondingly facilitate the independent movement of each of said valves for the selective flow of firefighting agent through said primary conduit, said secondary conduit, and said third conduit.

6. A nozzle device as in claim 5 wherein said housing includes a nozzle, gripper handle protruding therefrom, said nozzle handle being structured and disposed to facilitate said housing to be held and maneuvered during use.

7. A nozzle device as in claim 1 wherein said triple flow hose includes a proximal end secured in corresponding triple fluid flow communication with a multiple agent source.

8. A nozzle device as in claim 7 wherein said proximal end of said triple hose includes an air inlet adapted to be engaged with a compressed air source of said multi-agent source such that at least one of said agent conduits of said triple hose is filled with compressed air until actual use of one of said agents is needed.

9. A fire suppression nozzle device, comprising:

a housing having an upstream end and a downstream end, said housing including a primary water conduit extending therethrough, said primary water conduit being structured and disposed to transmit water at a substantially high pressure and high volume of at least 50 gallons per minute therethrough, an adjustable flow tip on a downstream, open end of said primary conduit, said flow tip controlling the type of spray emission of water from said primary conduit, a first, exteriorly operable flow control valve in said primary conduit, said first valve being structured and disposed to regulate the flow through said primary conduit between a maximum flow position and a no flow position, said housing further including a secondary conduit, said secondary conduit extending parallel with said primary conduit from said upstream end of said housing, said secondary conduit including a venturi outlet at a downstream end thereof, said venturi outlet extending into said primary conduit such that fluid flowing through said secondary conduit will pass into said primary conduit, as a result of a venturi effect suction caused when the water passes through said primary conduit, for subsequent passage out of said housing through said adjustable flow tip on said primary conduit, a second exteriorly operable valve in said secondary conduit, said second valve regulating the flow of fluid through said secondary conduit between no flow and maximum flow, said housing including a third conduit, capable of directing a high pressure flow therethrough, extending substantially parallel with said primary conduit, said third conduit having a fixed emission tip structured and disposed to be independently operable, a third exteriorly operable flow control valve in said third conduit, said third valve being structured and disposed to allow concentrated fluid bursts, constant flow, or zero flow through said fixed emission tip of said third conduit, hook up means at said upstream end of said housing, said hook up means being structured and disposed to securely receive a triple flow hose, and said trip flow hose including a lock head and at least three independent agent conduits, said lock head being structured and disposed for secure fluid flow connection at said upstream end of said housing such that each of said agent conduits is correspondingly connected with said primary conduit, said secondary conduit, and said third conduit.

* * * * *